United States Patent [19]

Puett

[11] Patent Number: 5,072,574

[45] Date of Patent: Dec. 17, 1991

[54] VACUUM PACKAGING MACHINE

[75] Inventor: Cecil E. Puett, Las Vegas, Nev.

[73] Assignee: Sunclipse, Inc., Montebello, Calif.

[21] Appl. No.: 524,149

[22] Filed: May 15, 1990

[51] Int. Cl.[5] ..... B65B 11/52

[52] U.S. Cl. ..... 53/427; 53/509; 53/168

[58] Field of Search ..... 53/390, 427, 432, 433, 53/509, 510, 511, 391, 168

[56] References Cited

U.S. PATENT DOCUMENTS

| | | | |
|---|---|---|---|
| 2,976,658 | 3/1961 | Kostur | 53/509 |
| 3,377,770 | 4/1968 | Rorer | 53/509 |
| 3,501,886 | 3/1970 | Watts et al. | 53/427 |
| 3,830,365 | 8/1974 | Krueger et al. | 53/511 X |
| 3,910,008 | 10/1975 | Johnson | 53/511 X |
| 3,977,156 | 8/1976 | Rorer | 53/511 |
| 3,988,093 | 10/1976 | Birchenough | 53/509 X |
| 4,188,770 | 2/1980 | Tabur | 53/509 |
| 4,400,612 | 8/1983 | Lee | 53/509 |
| 4,418,511 | 12/1983 | Collin | 53/509 X |
| 4,748,797 | 6/1988 | Martin | 53/432 |

OTHER PUBLICATIONS

Advertising Brochure-ZED Industries, *Skin Packer.*
Advertising Brochure-ZED Industries, *The Best in Skin Packaging Equipment.*
Advertisement-*HDVS Available with Automatic Infeed Template.*
Advertising Brochure-M. Latter, *The M. Latter Skin Packaging Machine.*
Advertisement-ALLOYD, Alloyd Packaging Report Consumer Electronics, *Tandy's Dandy,* 1989-90, p. 17.
Advertising Brochure-AMPAK, Inc., Technical Data, *Master Series III Skin Packaging Machine.*
Advertising Brochure-Stone Container, *Automatic System for Skin Packaging Featuring Microprocessor Controller SPM 101SL.*
Advertisement-APV Crepaco, Inc., p. 5.
Advertisement-APS Packaging System, *Shrink and Sleeve Wrap Packaging Equipment.*
Advertisement Page-Miscellaneous Advertisements.
Advertising Brochure-HANNAN Products Corp., *420 T Skin Packaging Vacuum Forming Machinery.*
Advertising Brochure-Q VAC, *Skin Packaging Blister and Vacuum Forming Machine Roller Press Die Cutter.*
Advertising Brochure-CHASE Industries, Inc., Packaging Systems, *L-Sealers Shrink Tunnels.*
Advertising Brochure-Q VAC, *Fully Automatic Vacuum Forming Machine.*
Advertising Brochure-L Enterprises, Inc., *Semi Automatic Skin Packaging/Vacuum Forming.*
Advertising Brochure-Visual Thermoforming Ltd., *Skin Packaging Machinery.*
United States Department of Commerce Patent and Trademark Office, Vacuum Packaging Machines-Disclosure Document No. 234587, pp. 1-15.
Advertising Brochure-SERGEANT Skin Packaging Systems, Allied Automation, Inc.

*Primary Examiner*—John Sipos
*Assistant Examiner*—Linda B. Johnson
*Attorney, Agent, or Firm*—Beehler & Pavitt

[57] ABSTRACT

A vacuum packaging apparatus for packaging a product between a plastic film and a backing card comprises a base having a stationary heating hood. A reciprocal table is mounted on the base beneath the hood. Two packaging wells are mounted side by side on the table, each well being dimensioned for holding a backing board on which the product is placed for packaging. The reciprocal table moves laterally on the base so that when one packaging well is in a packaging position under the hood, the other packaging well is not and extends out from beneath the hood. A sealing frame is mounted on the base beneath the hood for holding a sheet of wrapping material and moves vertically between a raised position and a lowered position. In the raised position, the sealing frame is adjacent the heating hood to heat the sheet. In the lowered position the sealing frame is adjacent the packaging well which is in packaging position to place the heated sheet over the board. Vacuum motors are mounted in the base beneath the hood, under the reciprocal table. When the sealing frame is lowered to place the heated sheet over the board in packaging position, a vacuum is drawn against the backing board to seal the heated sheet over the product onto the backing board. A method for packaging using the apparatus is also included.

11 Claims, 2 Drawing Sheets

VACUUM PACKAGING MACHINE

FIELD OF THE INVENTION

This invention relates generally to apparatus for packaging various items. More specifically, the invention relates to a vacuum packaging machine for securing wrapping material over a product which has been placed on a backing board. The present invention is particularly, though not exclusively, useful for shrink wrapping a clear plastic film onto a printed cardboard backing card to enclose and package a product between the plastic film and the backing card.

BACKGROUND OF THE INVENTION

There are many types of vacuum packaging devices which use a vacuum to draw a sheet of plastic film onto a backing card for packaging a product. Conventional vacuum packaging machines typically include a fixed platen or table on which a cardboard backing card is placed. A product or products are positioned by an operator on the backing card, and a sheet of plastic film is placed over the product to cover the product and the card. The sheet is typically heated prior to or during its placement over the product and the card, and after such placement, a vacuum is drawn from beneath the card to remove air from between the card and the film to seal the film over the product onto the card. The sealed package containing the product is then cut to the desired size.

There are several disadvantages, however, associated with use of conventional vacuum packaging machines. For example, in order to provide the necessary heating of the wrapping film, some conventional machines use a movable heating hood assembly. Such movable heating hood assemblies are typically constructed to move horizontally back and forth over the work area where the film is to be sealed over the product and card. To avoid burning the operator, such movable hoods are typically designed to generate heat only after they are moved by the operator into position. Also, such conventional hoods use electric rods or bulb heating elements which take some time to heat and/or cool. The steps of moving the hood into and out of position, and the heating and cooling times unfortunately add unwanted time which results in lower productivity in the packaging process.

Other conventional packaging apparatus which use a stationary heating hood require that the backing board be placed by an operator onto the platen, which is fixed in position under the heating hood in the packaging work area. This requires that the operator reach into the packaging work area to place the backing card in position, and to reach into the work area to position the product or products in proper orientation onto the backing board. This placing and positioning of the product onto the backing board cannot, however, occur during the packaging operation. Instead, the operator must wait until the packaging operation is completed and the completed board is removed, before the operator can begin to place the next board on the platen and position products on the board. This tends to slow the packaging operation. Also, since the placing and positioning of the product occurs under the heating hood, there is an increased chance that the operator may inadvertently touch the heating hood while it is still hot. In such circumstances, there is an increased danger that the operator may be burned.

In light of the above, the present invention thus recognizes the need for a vacuum packaging machine which is safe and convenient to operate. The present invention also recognizes the desire to increase packaging productivity. The present invention further recognizes the need for a vacuum packaging machine which is designed to provide greater stability and durability in use.

Accordingly, it is an object of the present invention to provide a vacuum packaging apparatus which vacuum packages wrapping material about a product, while at the same time the operator is able to position additional product on the next board for the next packaging operation. It is another object of the present invention to provide a packaging apparatus which operates in a safe yet highly productive manner. It is yet another object of the present invention to provide a packaging apparatus which is durable and reliable in operation, and which can be easily serviced. Still another object of the present invention is to provide a packaging machine which is simple and convenient to operate, and which is cost-effective in its manufacture.

SUMMARY OF THE INVENTION

A preferred embodiment of the vacuum packaging machine for vacuum sealing a plastic film over a product to hold the product securely on a backing board comprises a base having a stationary heating hood. Mounted in the base beneath the heating hood are vacuum motors, and a reciprocal table is mounted on the base between the stationary heating hood and the vacuum motors. As intended for the present invention, the table carries two packaging wells which are arranged in a side-by-side relationship, and each packaging well is provided with rollers which hold and support a backing board as it is placed in the packaging well. The table is reciprocable horizontally in a lateral direction so that when one packaging well is positioned beneath the hood, the other packaging well extends from the base and out from underneath the heating hood.

A sealing frame is mounted on the base beneath the heating hood, and includes a top frame and a bottom frame hingedly connected together. The top frame is movable to an open position which allows loading of a sheet of plastic film into the sealing frame, as well as removal of the final packaged product. The top frame is further movable to a closed position in which the top frame is placed over the bottom frame to hold the plastic sheet taut between the top and bottom frames. The bottom frame is connected to a lift which is mounted in the base to move the sealing frame up and down vertically between a heating position, and a sealing position. When in the heating position, the sealing frame is adjacent the heating hood in order to heat the sheet of wrapping material that is held in the frame. Alternately, when the sealing frame is dropped into the sealing position, the frame positions the sheet of wrapping material over the packaging well which is in position beneath the heating hood.

The vacuum motors are mounted on a platform which is located within the base and beneath the reciprocable table which carries the packaging wells. The platform on which the vacuum motors are mounted is connected to a lift that is attached to the base. Operation of this lift raises and lowers the platform (and vacuum motors) between a raised position and a lowered position. In the raised position, the vacuum motors are positioned adjacent whichever of the packaging wells happens to be positioned under the heating hood. The vacuum motors can then be activated to establish a vacuum seal of the film around the products and onto the backing board which was previously placed in the packaging well. When the vacuum motors are not in use, the platform on which the vacuum motors are mounted is maintained in the lowered position.

The preferred embodiment further includes a covered storage cabinet, located at the bottom rear of the base, in which a rotatable shaft is mounted to hold a roll of wrapping material. A feed roller is mounted on the base above the rotatable shaft and adjacent the sealing frame when the sealing frame is in its lowered or packaging position. With the roll of wrapping material so positioned, wrapping material can be pulled by the operator from the roll, across the feed roller, and into the sealing frame.

The method of vacuum packaging according to the present invention comprises the steps of placing a backing board onto whichever of the packaging wells is not positioned under the heating hood, and then placing a product on the backing board. While product is being placed on the one backing board, the sealing frame is opened and a sheet of wrapping material is pulled across the frame. Once the wrapping has been pulled across the sealing frame, the top frame is closed onto the bottom frame to hold the sheet in the sealing frame. The sealing frame which holds the sheet of wrapping material is raised to the heating position adjacent the hood. Simultaneously, the table is slidably moved to position the packaging well which carries the backing board and product in a packaging position beneath the heating hood. After the sealing frame has held the sheet of wrapping material in the heating position for a sufficient time, the heated sheet is then lowered onto the backing board and product which is in the packaging well that has been moved beneath the hood. At the same time the heated sheet is being lowered, the vacuum motors are raised by the lift into position under the backing board. A vacuum is then drawn to seal the heated sheet of wrapping material over the product and thus package the product onto the backing board. During this process, the operator has had ample time to place another backing board on the packaging well which is not under the heating hood, and position the product thereon for the next packaging operation. Once the product has been packaged onto the board, the sealing frame is opened by the operator to remove the packaged product. It is to be appreciated that removal of the packaged product also pulls the sheet of wrapping material across the sealing frame to load another sheet of wrapping material into the sealing frame. The packaged product can then be separated from the sheet of wrapping material and the operator may immediately continue and repeat the packaging operation.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
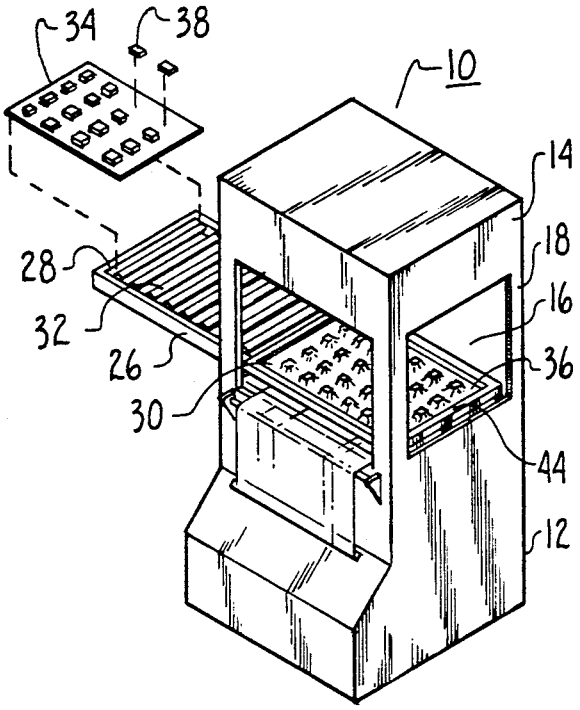
FIG. 1 is a perspective view of a preferred embodiment of a vacuum packaging apparatus being loaded for use in accordance with the present invention.
Figure 2:
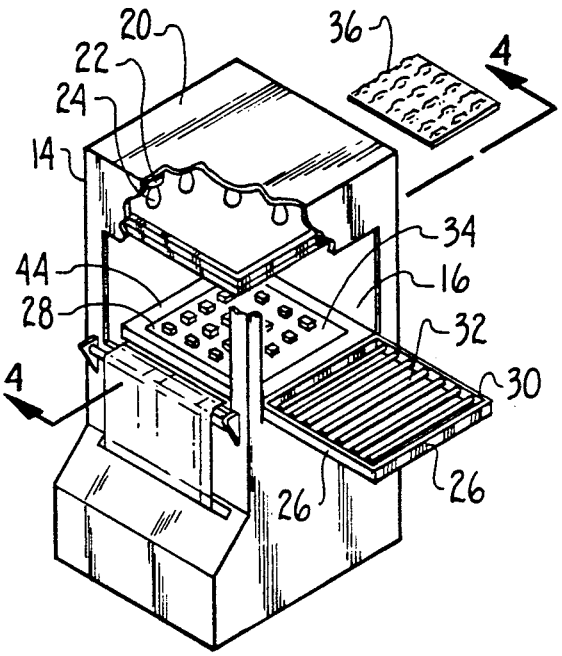
FIG. 2 is a perspective view of the apparatus shown in FIG. 1 with portions, cut away for clarity.
Figure 3:
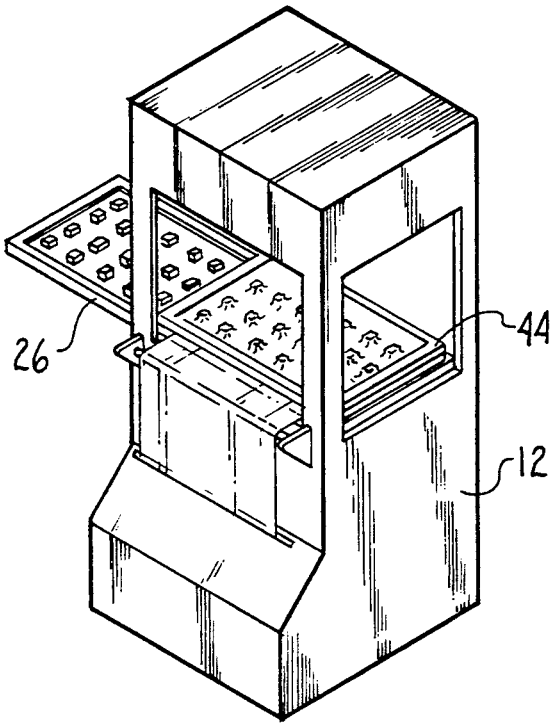
FIG. 3 is a perspective view of the apparatus shown in FIG. 1 further illustrating the packaging process.

Referring now to FIGS. 1, 2 and 3, there is shown a vacuum packaging apparatus 10 for packaging a product between a sheet of wrapping material and a backing board. In particular, apparatus 10 includes a base 12, which includes a stationary heating hood 14. Heating hood 14 is supported above an open packaging work area 16 by vertical support members 18. Vertical support members 18 are attached to base 12 and support heating hood 14 at a predetermined distance above the work area 16 as substantially shown in FIG. 1. For purposes of the present invention, base 12, support members 18, and hood 14 may advantageously be made of a strong and durable material, such as steel.

As can be seen in FIGS. 2, 4, 5 and 6, an array of heating elements 20 are mounted in heating hood 14. In the preferred embodiment shown, each heating element 20 comprises a two-piece ceramic socket 22 and one-piece wire-wrapped ceramic cone 24. Each cone 24 is screwed into a respective socket 22, and may be conveniently and individually removed or replaced. To obtain uniform heating, the heating elements 20 are wired in series to a power supply (not shown) which supplies uniform power to all sockets 22.

Still referring to FIGS. 1, 2 and 3, it can be appreciated that a reciprocal table 26 is mounted on base 12, beneath stationary hood 14. As shown, table 26 is movable laterally in a horizontal direction, in a plane substantially parallel to the plane of the array of heating elements 20 mounted in hood 14. It can also be seen that table 26 includes two packaging wells 28 and 30, which are positioned next to each other in a side-by-side relationship. With this arrangement, table 26 can be reciprocated laterally so that when one packaging well is positioned under hood 14, the other packaging well is not positioned under hood 14 and, instead, extends outwardly from base 12 substantially as shown in FIGS. 1, 2 and 3. Each packaging well 28 and 30 has rollers 32, and is designed to hold a backing board 34 and 36, respectively. Each backing board 34 and 36 may be paper, cardboard, or some similar porous packaging material well known in the art.

Figure 4:
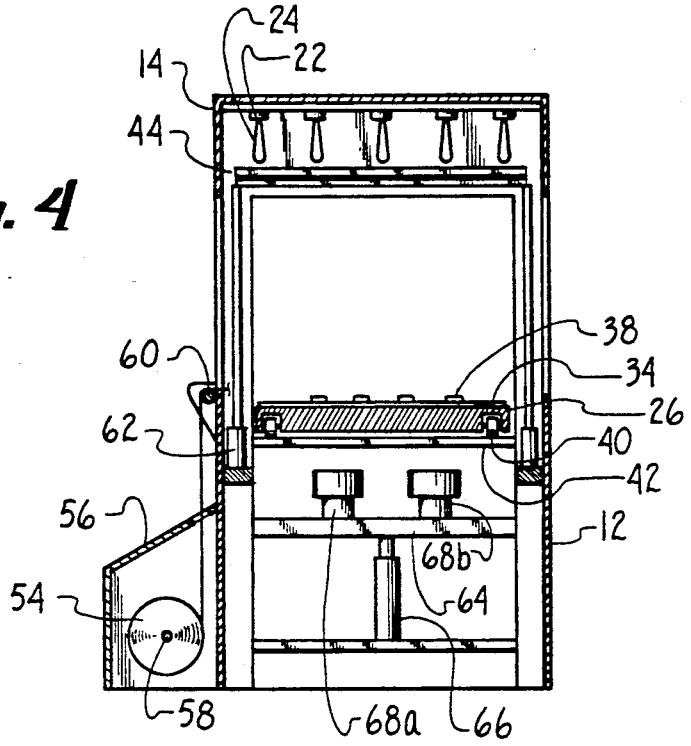
FIG. 4 is a sectional side view taken along the line 4-4 of the apparatus shown in FIG. 2, illustrating the heating of wrapping material during the packaging process.

As further shown in FIG. 4, reciprocal movable table 26 has rollers 40 which roll on the tracks 42 that are fastened to base 12. Table 26 is slidingly driven in the lateral direction by a motor (not shown). As can be appreciated with reference to FIGS. 1 and 3, table 26 may be slidably positioned so that packaging well 28 is outside of packaging work area 16 and not under hood 14. When packaging well 28 is thus positioned, the other packaging well 30 is positioned within packaging work area 16, which is beneath hood 14. Alternatively, when table 26 is slidably moved to the position shown in FIG.

2, packaging well 28 is within packaging work area 16, directly beneath hood 14, while the other packaging well 30 is positioned outside of packaging work area 16, and out from under hood 14. This allows alternating access by the operator to whichever of the packaging wells 28, 30 is not under hood 14 to place backing boards in the accessible well and position product 38 thereon. This greatly enhances productivity in operation since the operator can gain direct access for loading purposes to the packaging wells easily without the need to reach into the packaging work area.

Figure 5:
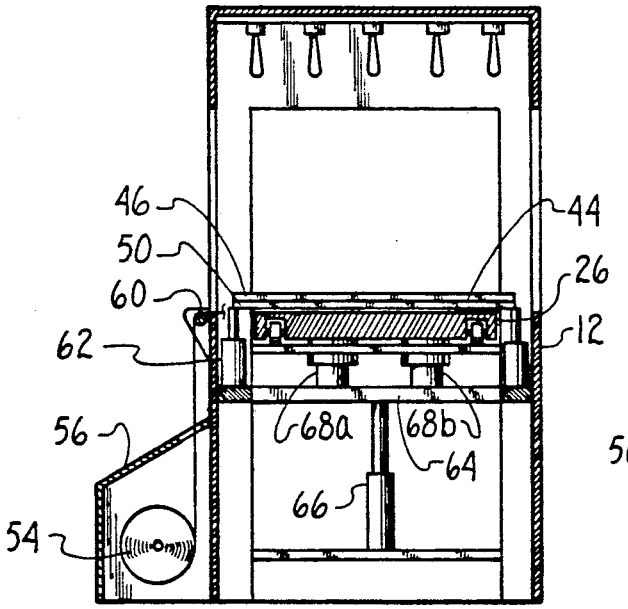
FIG. 5 is a sectional side view of the apparatus shown in FIG. 4 illustrating the drawing of a vacuum during the packaging process.
Figure 6:
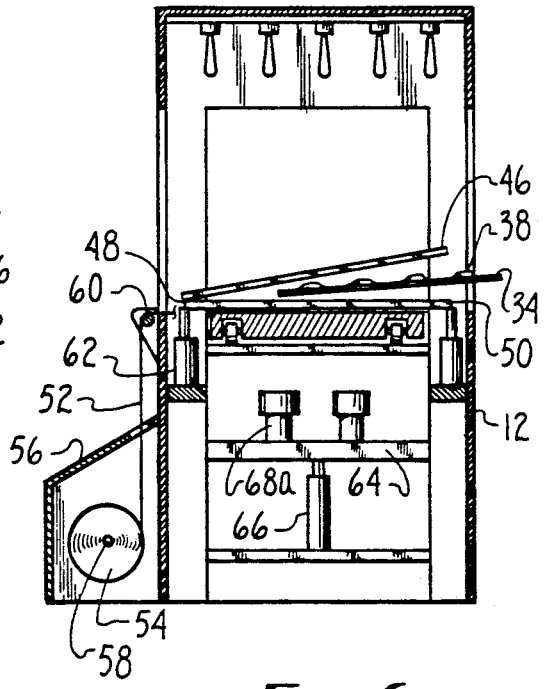
FIG. 6 is a sectional side view of the apparatus shown in FIG. 4 illustrating the removal of a packaged product.

As further shown in the drawings, a sealing frame 44 is mounted to the base 12 under hood 14. Sealing frame 44 is of approximate dimensions sufficient to fit over each packaging well 28, 30 as described below. Sealing frame 44 has a top frame 46 which is hingedly connected at pivot point 48 to a bottom frame 50, as seen in FIGS. 4, 5 and 6. As can perhaps best be appreciated with reference to FIG. 6, top frame 46 may be pivotally raised to remove the completed board after it has been packaged. Also, when top frame 46 is raised, a section of sheet 52 of wrapping material may be drawn into frame 44. The wrapping material may be clear plastic film, or some other suitable nonporous thin sheet 52 wrapping material. For example, various well known commercially available films such as Surlyn, PVC, Polyethylene, Barex or Visqueen can be used. Sheet 52 is fed from roll 54 which is held on a rotating shaft 58 mounted in covered rear cabinet 56 of base 12. The covered rear cabinet 56 keeps dirt and dust away from roll 54, and helps maintain cleanliness of sheet 52. A feed roller 60 is mounted on the rear of base 12 above covered rear cabinet 56 so the operator can conveniently pull sheet 52 from roll 54 over feed roller 60 and through the rear of sealing frame 44 across bottom frame 50. Top frame 46 can then be lowered onto lower frame 50 to hold the section of sheet 52 taut across closed sealing frame 44.

Bottom frame 50 of sealing frame 44 is attached at its edges to the expandable and contractable lift cylinders 62 which are mounted in base 12. As can be appreciated by the skilled artisan, cylinders 62 may be air or hydraulic cylinders actuated by conventional apparatus well known in the art. In the preferred embodiment, lift cylinders 62 are powered by a conventional air over hydraulic system (not shown) in which air moves the hydraulic fluid out of its reservoir to control the length and speed of cylinder arm movement. In FIG. 4, lift cylinders 62 are shown in the expanded position in which sealing frame 44 has been raised to a location adjacent ceramic heating cones 24 in hood 14. In FIG. 5, lift cylinders 62 are shown in a retracted position in which sealing frame 44 has been lowered to a location adjacent whichever packaging well 28 or 30 is located beneath hood 14.

Mounted in base 12 beneath reciprocal table 26 is a platform or frame 64, which has a pair of vacuum motors 68*a* and 68*b* mounted thereon. Platform 64 is connected to a lift cylinder 66 fixedly mounted in base 12 with cylinder 66 controllably expandable to raise and lower platform 64. When platform 64 is in a raised position as shown in FIG. 5, vacuum motors 68*a* and 68*b* are located adjacent the bottom of whichever of packaging wells 28, 30 is positioned beneath hood 14. In the raised position, the vacuum motors 68*a* and 68*b* are sufficiently close to packaging well 28 or 30 to establish a vacuum seal of sheet 52 onto backing board 34. When platform 64 is in its lowered position, as shown in FIGS. 4 and 6, vacuum motors 68*a* and 68*b* are not in use and are located away from packaging wells 28, 30, out of the way of table 26 below track 42.

In operation, an operator places a backing board 34 onto packaging well 28 which is extended out from beneath hood 14, as shown in FIG. 1. The operator places one or more products 38 into desired orientation on board 34. As also shown in FIG. 1, a previously packaged board 36 which is already wrapped with sheet 52 from a previous packaging operation is still in packaging well 30. Sealing frame 44 is opened, as seen in FIG. 6. With sealing frame 44 opened, board 36 can be removed from packaging well 30 and, as board 36 is removed, a sheet 52 of wrapping material is pulled across bottom frame 50. Top frame 46 is then lowered to hold sheet 52 in sealing frame 44.

The actual cycle of events in the packaging process can be best appreciated by starting from a configuration in which a sheet 52 of wrapping material is held within sealing frame 44 and a backing board 34 has been loaded with product 38. At this point, the operator presses a start button (not shown) to begin a packaging cycle or operation. As the cycle starts, table 26 is automatically moved horizontally to locate packaging well 28 into packaging work area 16 beneath hood 14 (see transformation from FIG. 1 to FIG. 2). Simultaneously, cylinders 62 are activated which raise sealing frame 44 to a raised position adjacent heating elements 20 as shown in FIGS. 2 and 4. Ceramic cones 24 are energized to heat plastic sheet 52 for a sufficient time to make wrapping material 52 sufficiently pliant to allow it to be subsequently vacuum sealed properly onto board 34. In the preferred embodiment to reach proper sealing temperature, sheet 52 is held approximately two (2) inches from ceramic cones 24 for an interval of approximately twelve (12) seconds.

After the heating interval, a timing switch (not shown) then activates cylinder 62 to lower sealing frame 44 to a sealing position as shown in FIGS. 3 and 5. Simultaneously, lift cylinder 66 is activated to raise vacuum motors 68 into position under table 26 as shown in FIG. 5. Once sealing frame 44 has been lowered into the packaging position, sealing frame 44 fits onto packaging well 28 to establish a sealed engagement over board 34 and product 38. Sealing frame 44 thus positions sheet 52 so that it covers board 34. Once in position, vacuum motors 68 are activated to remove air from between sheet 52 and board 34. This vacuum seals the heated sheet 52 over the product 38 and onto board 34. Thus, product 38 is packaged onto board 34. Top frame 46 is then again opened by the operator to separate top frame 46 from bottom frame 50 as shown in FIG. 6. The completed vacuum packaged product 38 on board 34 is then removed by the operator from sealing frame 44 and packaging well 28. It should be noted that since sheet 52 is still secured to board 34, by removing the completed board 34 from frame 44, the operator pulls a new section of sheet 52 of wrapping material from roll 54 into position across bottom frame 50. Top frame 46 is then lowered by the operator onto bottom frame 50 which holds the new section of sheet 52 in closed sealing frame 44 for the next vacuum packaging operation. Also, after the packaged board 34 is removed from sealing frame 44, the completed board 34 is separated from sheet 52. Meanwhile, as the above steps are being accomplished, the operator has had ample time to place the next backing board onto vacant packaging well 30 which is extended out from beneath hood 14, and to position product 38 on such next board. Consequently, to repeat the process, the operator presses the start button to raise sealing frame 44 and move packaging well 30 and such next board into packaging position.

While the particular vacuum packaging machine as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. A vacuum packaging apparatus for sealing product between a sheet of wrapping material and a backing board, comprising:

a base having a stationary heating hood mounted on top of said base, said base further comprising a first side with a first access and a second side opposite said first side with a second access for defining a product work area under said hood and between said sides;

a horizontal table comprising, a first packaging well and a second packaging well juxtaposed on said table, said table being reciprocally mounted on said base for movement in a first direction wherein said first packaging well and a first backing board and product thereon are moved into said work area through said first access and said second packaging well and a packaged second product are moved out of said work area through said second access, said table being moveable in a second direction opposite said first direction for returning said second packaging well, another backing board and a third product into said work area through said second access and returning said first packaging well and the packaged first product out of said work area through said first access to alternatingly move said first and said second packaging wells into a packaging position beneath said hood;

a sealing frame movably mounted on said base for holding said sheet of wrapping material;

means for moving said sealing frame between a first position wherein said sealing frame is positioned adjacent said heating hood for heating said sheet, and a second position wherein said sealing frame is positioned adjacent said table in said product work area to place a heated sheet over a backing board placed in one of said packaging wells; and vacuum means associated with said packaging well for drawing a vacuum through said backing board and against said heated sheet to seal said heated sheet onto said backing board.

2. A vacuum packaging apparatus as recited in claim 1, wherein said heating hood includes ceramic cone heating elements.

3. A vacuum packaging apparatus as recited in claim 1, wherein said sealing frame comprises a bottom frame, and a top frame hingedly connected to said bottom frame.

4. A vacuum packaging apparatus as recited in claim 3, wherein said sealing frame is movable between an open position wherein said sheet of wrapping material may be positioned across said bottom frame, and a closed position wherein said sheet of wrapping material is held securely in said sealing frame.

5. A vacuum packaging apparatus as recited in claim 1, further comprising means for moving said vacuum means between a first position wherein said vacuum means is spaced apart from one of said packaging wells in said work area, and a second position wherein said vacuum means is positioned adjacent one of said packaging wells in said packaging work area for drawing a vacuum through said backing board and against said heated sheet.

6. A vacuum packaging apparatus as recited in claim 1, further comprising covered means positioned at a rear portion of said base below said packaging well for mounting a roll of said wrapping material.

7. An apparatus for vacuum packaging, comprising:

a base having a top, a first side with a first access and a second side opposite said first side with a second access to establish a product work area therebetween;

stationary heating element means attached to said top of said base;

a table movably mounted on said base, said table having a first and a second well means in a side-by-side relationship for movement in a first direction wherein said first well means and a first backing board and product thereon move through said first access into said work area and said second well means and a packaged second product move through said second access out of said work area, and in a second direction opposite said first direction wherein said second well means, another backing board and a third product move through said second access into said work area and said first well means and the packaged first product move out of said work area;

frame means for holding a sheet of wrapping material;

lift means coupled to said frame means for moving said frame means between a heating position wherein said sheet is held adjacent said stationary heating element means to heat said sheet, and a sealing position wherein said frame means is seated adjacent said table in said packaging work area to place said heated sheet over one of said backing boards positioned in said work area on said table; and vacuum means associated with said table for drawing said heated sheet against said backing board on said table in said work area to seal said sheet onto said backing board.

8. An apparatus for vacuum packaging as recited in claim 7, wherein said frame means includes a top frame hingedly connected to a bottom frame.

9. An apparatus for vacuum packaging as recited in claim 8, wherein said vacuum means is movable between a first position wherein said vacuum means is spaced apart and positioned beneath one of said well means in said work area, and a second position wherein said vacuum means is positioned adjacent one of said well means in said work area for drawing a vacuum against said backing board.

10. An apparatus for vacuum packaging as recited in claim 9, wherein said heating element means comprises a heating hood having a plurality of ceramic heating elements.

11. A method of vacuum packaging comprising the steps of:

providing an apparatus having a base, a heating hood mounted on said base, said base being formed with a first side having a first access and a second side opposite said first side having a second access for defining a product work area between said sides, a reciprocally moveable table mounted on said base, said table comprising a first packaging well and a second packaging well juxtaposed therewith, a sealing frame movably mounted on said base for holding a sheet of wrapping material, and a vacuum means mounted on said base;

placing a first backing board into said first packaging well and placing a product on said first backing board;

placing a first sheet of wrapping material in said sealing frame;

raising said sealing frame and said first sheet into a heating position adjacent said stationary hood to heat said sheet;

moving said first packaging well and said first packing board through said first access into said work area and simultaneously moving said second packaging well and said second backing board through said second access out of said work area;

lowering said sealing frame and said heated sheet onto said first backing board;

applying a vacuum to said first backing board to seal said heated sheet onto said first backing board;

placing a second backing board into said second packaging well and placing a product on said second backing board;

placing a second sheet of wrapping material in said sealing frame;

raising said sealing frame and said second sheet into said heating position;

moving said second packaging well and said second backing board through said second access into said packaging work area and simultaneously moving said first packaging well and said first backing board out through said first access out of said work area;

lowering said sealing frame and said heated sheet onto said second backing board while removing said first backing board from said first packaging well;

applying a vacuum to said backing board to seal said second heated sheet onto said second backing board; and repeating said steps as necessary.

* * * * *